US006929486B2

(12) United States Patent
Shimada

(10) Patent No.: US 6,929,486 B2
(45) Date of Patent: Aug. 16, 2005

(54) SOCKET FOR ELECTRICAL PARTS AND METHOD FOR USING THE SAME

(75) Inventor: Hideo Shimada, Kawaguchi (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 10/633,554

(22) Filed: Aug. 5, 2003

(65) Prior Publication Data

US 2004/0029427 A1 Feb. 12, 2004

(30) Foreign Application Priority Data

Aug. 8, 2002 (JP) ..... 2002-230876

(51) Int. Cl.[7] ..... H01R 12/00
(52) U.S. Cl. ..... 439/70; 439/331; 439/717
(58) Field of Search ..... 439/247, 701, 439/717, 331, 540.1, 70, 71, 65, 68, 73; 361/788, 791, 785, 808

(56) References Cited

U.S. PATENT DOCUMENTS 4,717,346 A * 1/1988 Yoshizaki ..... 439/71
4,815,987 A * 3/1989 Kawano et al. ..... 439/263
5,344,334 A * 9/1994 Laub et al. ..... 439/331
5,443,404 A * 8/1995 Matsuoka ..... 439/717
5,791,914 A * 8/1998 Loranger et al. ..... 439/71
6,527,597 B1 * 3/2003 Harper, Jr. ..... 439/701
6,602,084 B2 * 8/2003 Sagano et al. ..... 439/342

FOREIGN PATENT DOCUMENTS

JP SHO 61-1289 1/1986

* cited by examiner

*Primary Examiner*—Tho D. Ta
*Assistant Examiner*—Felix O. Figueroa
(74) *Attorney, Agent, or Firm*—Staas & Halsey LLP

(57) ABSTRACT

A socket for the electrical part of the present invention has a socket body to be mounted on a circuit board and to accommodate the electrical part and a contact pin disposed in the socket body, through which the circuit board and the electrical part are electrically connected. The socket body includes an accommodating surface portion to accommodate the electrical part. A height of the accommodating surface portion is an approximately the same height as that of another socket which is disposed next to the socket. And when a plurality of the sockets for the electrical part are disposed adjacently to each other, the electrical part can be mounted over a plurality of accommodating surface portions in such a manner as bridging the accommodating surface portions.

8 Claims, 15 Drawing Sheets

SOCKET FOR ELECTRICAL PARTS AND METHOD FOR USING THE SAME

BACKGROUND OF THE INVENTION

1. Field of the Invention

The present invention relates to a socket for electrical parts for detachably holding electrical parts such as a semiconductor device (which is called herein as an "IC package") or the like, to conduct electrical test and examination of the electrical parts. The present invention also relates to a method for using the socket for the electrical parts.

2. Related Art of the Invention

As a conventional socket of this kind, there have been an IC socket as a "socket for electrical parts" for conducting a burn-in test or the like of the IC package by detachably accommodating the IC package as an "electrical parts" on the socket.

The IC socket has a socket body on which the IC package is accommodated and in which a plurality of contact pins are disposed. To the socket body, a cover member is attached to be opened and closed for pressing the IC package.

The burn-in test or the like on the IC package can be carried out by previously mounting the IC socket on the printed circuit board, then opening the cover member and accommodating the IC package on the socket body, and then closing the cover member to establish an electrical connection between the IC package and the printed circuit board through the contact pin. In this state of the IC package, the burn-in test is carried out.

The IC package has a package body molded from resin, on which terminals are exposed. The terminals having an elongated shape are extended from a lateral side of the package body and having a various type such as a plate-type, gull wing-type or L-shaped type etc. There is also other type of terminals—for example a plate-type, a spherical-type or a rod-type terminal—which is exposed on a lower surface of the package body.

These packages are in some cases produced through a process in which a plurality of IC packages are formed in a long combined unit. In these cases, independent IC packages are produced by cutting the unit to separate them.

However, in the conventional IC package mentioned above, the burn-in test or the like is usually carried out by using one IC socket for each independent IC package. And there have been no proposal to conduct the burn-in test for the long combined IC package unit comprising a plurality of IC packages, by accommodating a long electrical part such as the long combined IC package unit etc. on a plurality of IC sockets in such a manner as bridging the plurality of the IC sockets.

In this connection, Japanese Published Utility Patent No. Sho 61-1289 discloses an example of aligning a plurality of IC sockets in a line. But the prior art does not disclose the adjacently disposed IC socket comprising a plurality of IC sockets on which the long combined IC package unit is mounted to carry out performance testing of the IC packages simultaneously.

Further there have been no proposal for a set of IC sockets on which an ordinary independent IC package, which is not a long combined IC package unit comprising a plurality of IC packages mentioned above, is mounted over the IC sockets in such a manner as bridging the IC sockets of the set of IC sockets.

SUMMARY OF THE INVENTION

Accordingly, an object of the present invention is to provide a socket for an electrical part which is structured to be able to accommodate one electrical part, in order to conduct an electrical test or examination etc. of the one electrical part through a plurality of sockets, in such a way that the electrical part is accommodated over the sockets, which are adjacently disposed, in such a manner as bridging the sockets. Another object of the present invention is to provide a method for using the socket having a structure mentioned above.

To achieve the above mentioned objects, an aspect of the present invention is characterized by providing a socket for an electrical part which comprises:

a socket body which is mounted on a circuit board and accommodates the electrical part; and a contact pin disposed in the socket body, through which the circuit board and the electrical part are electrically connected, the socket body comprising an accommodating surface portion to accommodate the electrical part, a height of the accommodating surface portion being an approximately the same height as that of another socket which is disposed next to the socket, and when a plurality of the sockets for the electrical part are adjacently disposed to each other, the electrical part can be mounted over a plurality of accommodating surface portions in such a manner as bridging the accommodating surface portions.

Another aspect of the present invention is characterized in that the accommodating surface portion is a floating plate made to be vertically moveable and urged upward, the floating plate having a through hole through which the contact pin is inserted.

Still another aspect of the present invention is characterized in that a peripheral edge portion of the accommodating surface portion is formed so as to be positioned at a place close to a peripheral edge portion of the accommodating surface portion of the another socket disposed next to the socket.

Still another aspect of the present invention is characterized in that the contact pins are disposed up to the peripheral edge portions of the accommodating surface portion.

Another aspect of the present invention is characterized in that a cover member is rotatably attached to the socket body and a pressing member for pressing the electrical part is attached to the cover member, pressing portions of the pressing members being arranged in such a manner as lined up in a plurality of rows along a right and left direction.

An aspect of another invention is characterized in that a socket for an electrical part which comprises:

a socket body to be mounted on a circuit board and to accommodate the electrical part; and a plurality of contact pins disposed in the socket body, through which the circuit board and the electrical part are electrically connected, the socket body having, a contact unit in which the contact pins are disposed, a cover supporting member attached to one end portion side of the contact unit, the cover supporting member having a cover member rotatably attached to the cover supporting member, and an engaging member for engaging with a front edge portion side of the cover member, the engaging member being provided at the other end portion side of the contact unit, the socket body is divided into three portions—the contact unit, the cover supporting member and the engaging member—.

Another aspect of the another invention is characterized in that the contact unit has an accommodating surface portion to accommodate the electrical part, a height of the accommodating surface portion being an approximately the same height as that of another socket which is disposed next to the socket, and when a plurality of the sockets for the electrical part are adjacently disposed, the electrical part can be mounted over a plurality of the accommodating surface portions in such a manner as bridging the adjacently disposed accommodating surface portions.

Still another aspect of the another invention is characterized in that a method for using the sockets for the electrical part mentioned above comprises installing a plurality of the sockets in an adjacent manner on the circuit board, and accommodating the electrical part over the accommodating surface portions of the sockets for the electrical part in such a manner as bridging the accommodating surface portions.

Still another aspect of the another invention is characterized in that a method for using the sockets for the electrical part mentioned above comprises disposing the peripheral edge portion of the accommodating surface portion of the socket in such a manner as almost contacting with the peripheral edge portion of the adjacent socket by installing the sockets for the electrical part adjacently to each other on the circuit board, and accommodating the electrical part over the accommodating surface portions in such a manner as bridging the accommodating surface portions.

According to the present invention, the socket body comprises an accommodating surface portion to accommodate the electrical part. The height of the accommodating surface portion is an approximately the same height as that of another socket which is disposed next to the socket. And when a plurality of the sockets for the electrical part are adjacently disposed to each other, the electrical part can be mounted over a plurality of accommodating surface portions in such a manner as bridging the accommodating surface portions. Therefore, as the socket of the present invention is different from a conventional socket which accommodates each independent IC package one by one, performance tests for even a long electrical part extending over a plurality of sockets can be effectively carried out in the present invention. Further, the electrical parts having different length can be properly accommodated and tested by changing the number of socket optionally.

According to another aspect of the present invention, a peripheral edge portion of the accommodating surface portion is formed so as to be positioned at a place close to a peripheral edge portion of the accommodating surface portion of the another socket disposed next to the socket. Therefore, no wider clearance exists between adjacent accommodating surface portions, so that the electrical part can be conveniently accommodated over the accommodating surface portions.

According to still another aspect of the present invention, the contact pins are disposed up to the peripheral edge portions of the accommodating surface portion. Therefore, even in the boundary portion between the adjacent accommodating surface portions, the electrical part's terminal can be contacted with the contact pin, being able to conduct the test etc.

According to another aspect of the present invention, a cover member is rotatably attached to the socket body and a pressing member for pressing the electrical part is attached to the cover member, pressing portions of the pressing members being arranged in such a manner as lined up in a plurality of rows along a right and left direction. Therefore, the terminals lined up in rows can be pressed effectively to the contact pins.

According to another invention, the socket body has a contact unit in which the contact pins are disposed, a cover supporting member attached to one end portion side of the contact unit, the cover supporting member having a cover member rotatably attached to the cover supporting member, and an engaging member for engaging with a front edge portion side of the cover member, the engaging member being provided at the other end portion side of the contact unit. And the socket body is divided into three parts—the contact unit, the cover supporting member and the engaging member—. Therefore, there is no frame-like portion on the side portion of the contact unit (on the side of the peripheral edge portion of the accommodating surface portion) so that the adjacent two accommodating surface portions can be disposed close to each other, being able to accommodate the electrical part over the adjacent accommodating surface portions. Performance test etc. of the electrical part can be effectively conducted. Further, in a case where a portion of one of the three divided parts, for example, deteriorates, the deteriorated portion can be easily replaced with good one.

According to another aspect of the another invention, the process of the method for using the sockets for the electrical part comprises installing the sockets in an adjacent manner on the circuit board, and accommodating a long electrical part over the accommodating surface portions of the sockets for the electrical part in such a manner as bridging the accommodating surface portions. Therefore, performance test etc. of the long electrical part can be suitably conducted.

The nature and further characteristic features of the present invention will be made more clear from the following descriptions made with reference to the accompanying drawings.

BRIEF DESCRIPTION OF THE DRAWINGS

In the accompanying drawings:

FIG. 6A shows a condition of the portion before an electrical part is accommodated; FIG. 6B shows another condition of the portion after the electrical part is accommodated;

DETAILED DESCRIPTION OF THE PRESENT INVENTION

Figure 1:
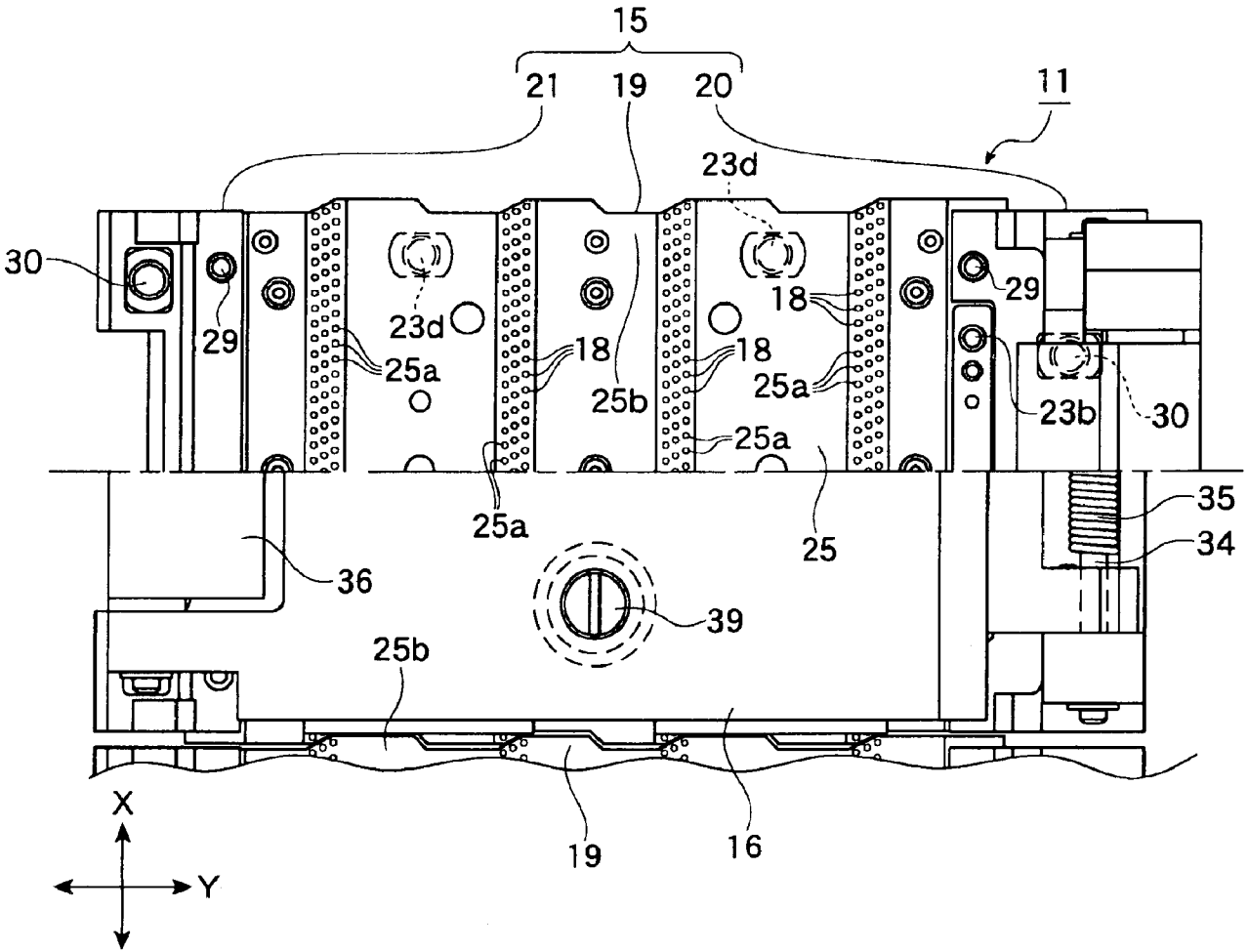
FIG. 1 is a plan view of an IC socket of a first embodiment of the present invention, an upper half of a cover member being opened.

Preferred embodiments of the present invention will be described hereunder with reference to the accompanying drawings.

In addition, it is to be noted that the terms "upper", "lower", "vertical", "right", "left" and the like described herein are used in the illustrated state or usable state of the socket or members associated herewith and also that a number of contact pins and terminals are actually arranged, though the description may be made with reference to single one thereof for the sake of easy understanding of the present invention.

FIRST EMBODIMENT

FIGS. 1 to 12 represent a first embodiment of the present invention.

At first, the structure of the embodiment will be described. Reference numeral 11 in the figures denotes what is called a clam shell type IC socket as a "socket for electrical part". The IC socket 11 is designed to conduct a performance test of an electrical part by establishing an electrical connection between a terminal of the electrical part and a printed circuit board 13 of a measuring device (tester).

The electrical parts of the first embodiment are arranged on the IC socket 11 in two rows along a cross direction (X direction in FIG. 1) of the socket and are arranged in prescribed rows along a width direction (Y direction in FIG. 1) of the socket. The IC package bodies are arranged at an interval of certain distance to each other to configure a long unit shape extending toward the socket's cross direction.

At a pair of side portions of each IC package body along the socket's cross direction, a plurality of strip-like terminals elongated in the width direction are disposed at an interval of certain distance in the cross direction. Four rows of terminals are provided along the socket's cross direction.

Further, at one side portion along the socket's width direction of the unit type IC package, two positioning holes are provided at an interval of certain distance in the width direction. Positioning pins 23*b*, to be hereinafter explained, of the IC socket 11 are inserted into these two positioning holes so that the IC package is positioned on the IC socket 11.

Figure 2:
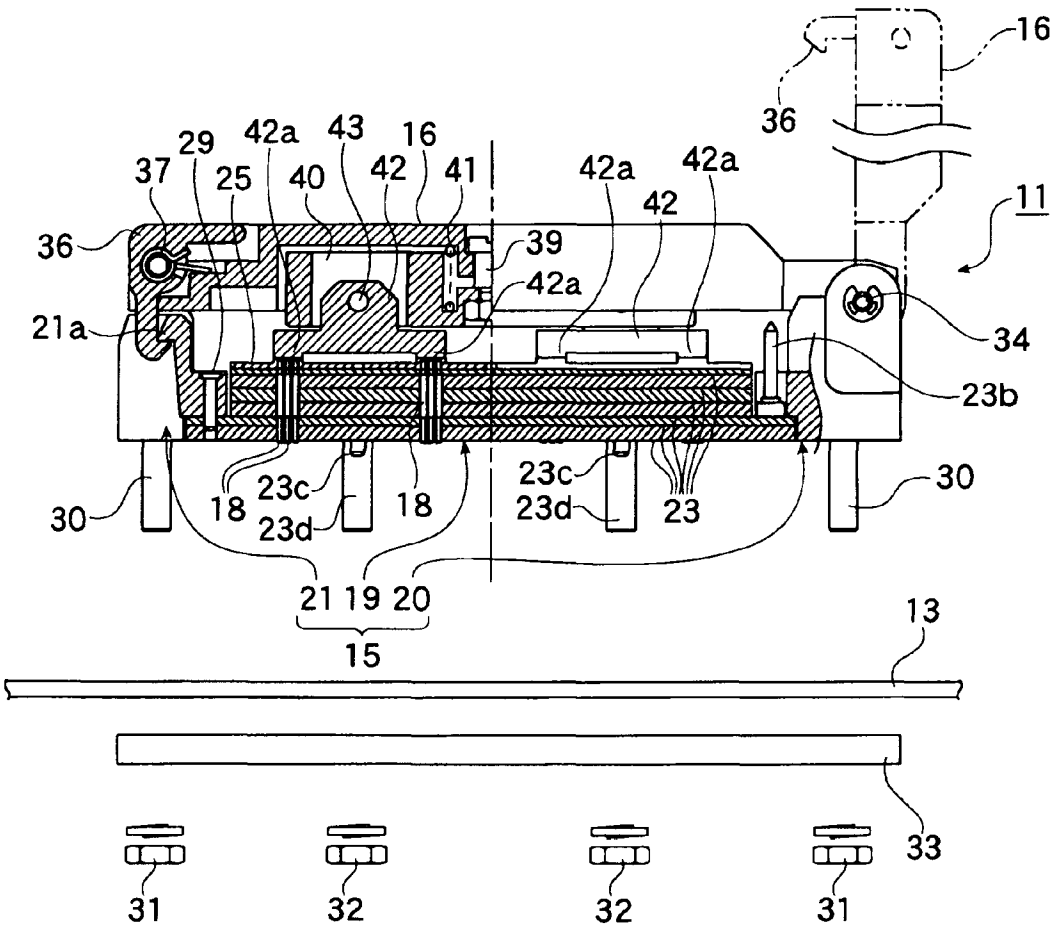
FIG. 2 is a front view of the IC socket of FIG. 1.

Furthermore, as shown in FIGS. 1 and 2, the IC socket 11 has a socket body 15 to be mounted on a printed circuit board 13. To the socket body 15, a cover member 16 is rotatably attached.

The socket body 15 is divided into three parts—a contact unit 19 to which a plurality of contact pins are disposed, a cover supporting member 20 attached to a rear end portion side (right end portion side in FIG. 2) of the contact unit 19, and an engaging member 21 attached to a front edge portion side (left end portion side in FIG. 2) of the contact unit 19—.

Figure 3:
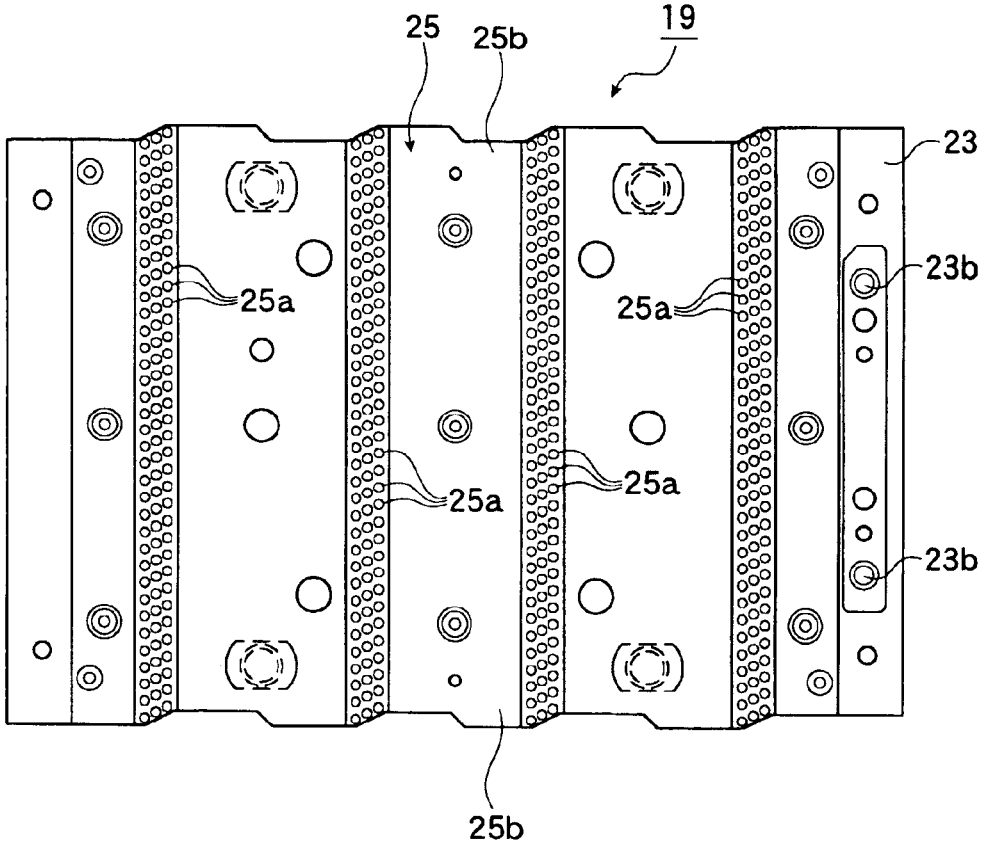
FIG. 3 is a plan view of a contact unit of FIG. 1.
Figure 4:
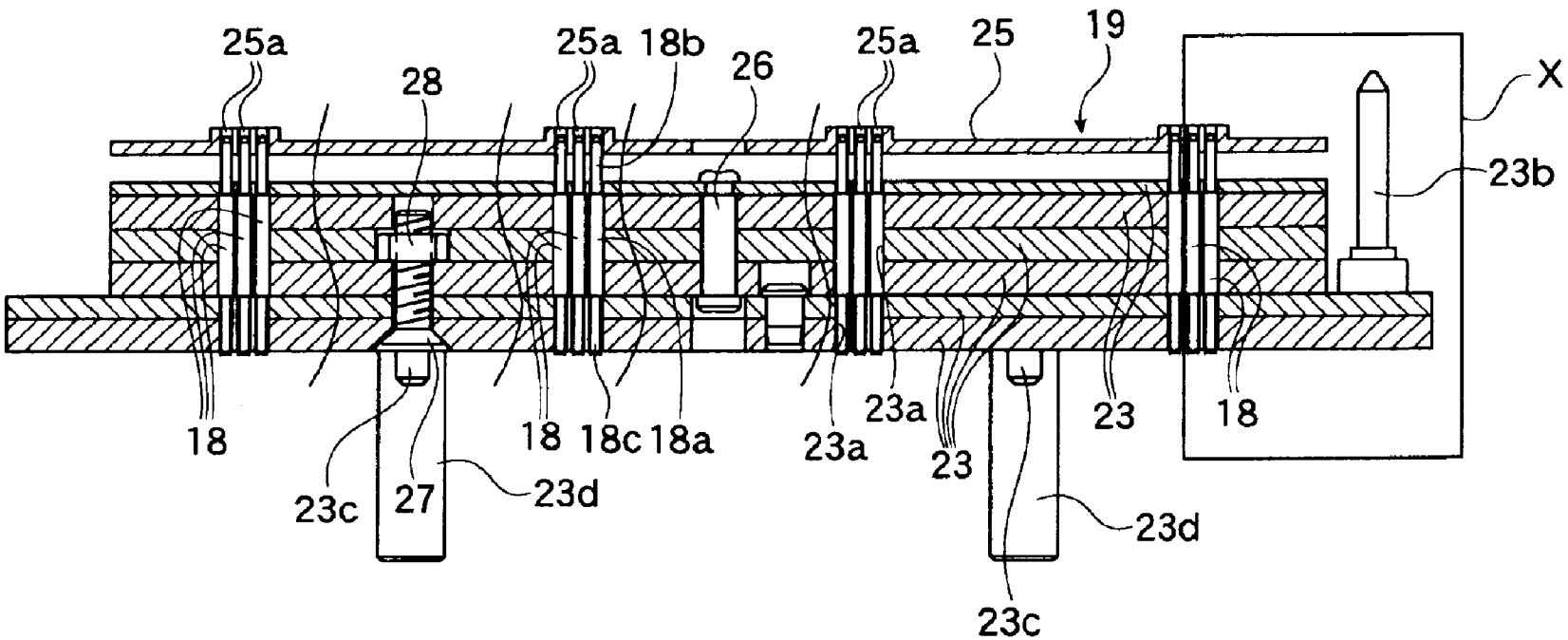
FIG. 4 is a cross sectional view of the contact unit of FIG. 1.
Figure 5:
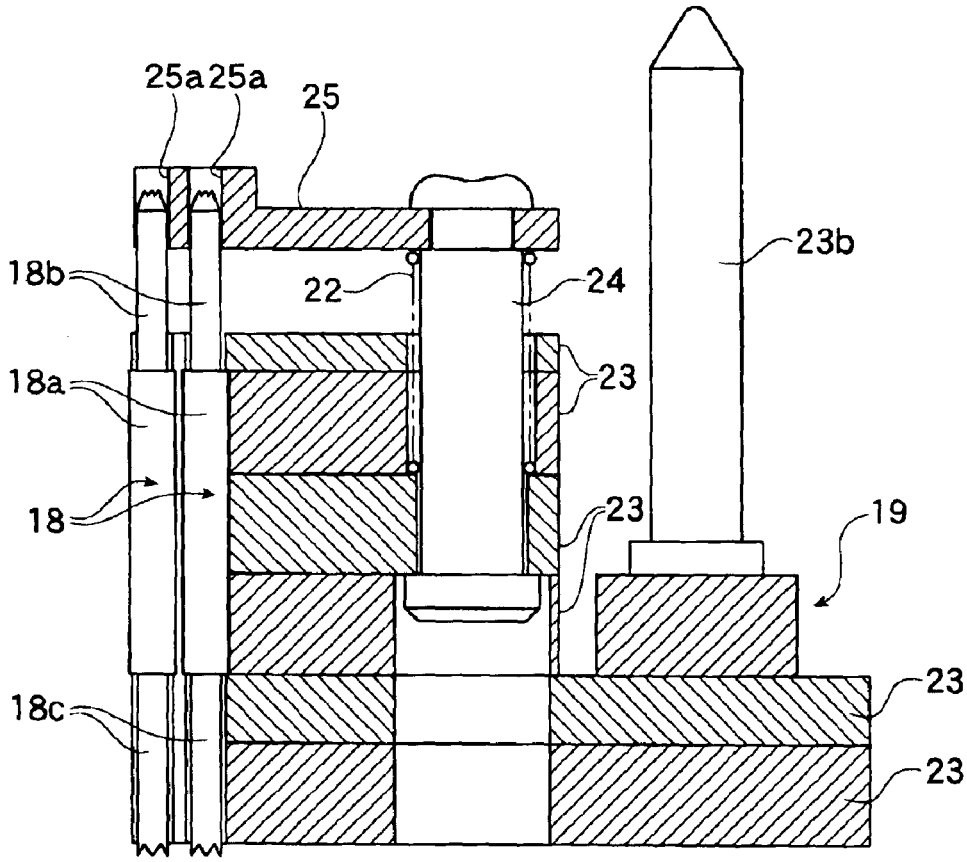
FIG. 5 is an enlarged cross sectional view of the X portion of FIG. 4.

As shown in FIGS. 3 to 5, the contact unit 19 is comprised of 6 plates 23 . . . , which are superimposed onto each other. Over an upper side of these plates 23 . . . , a floating plate 25 as an "accommodating surface portion" is disposed to be vertically moveable.

In these plates 23 . . . , a through hole 23*a* into which a contact pin is inserted and held is formed. And in the floating plate 25, a through hole 25*a* into which the contact pin 18 is inserted, is formed.

As shown in FIG. 4, the 6 plates are tied up together in a superimposed fashion by tying up upper side four plates with a rivet 26 and by tying up lower side three plates with a bolt 27 and a nut 28. The contact pin 18 is structured to be replaced with another one by unbolting the bolt 27 and then removing the lower two plates 23, 23.

As shown in FIG. 4, a width of the lower two plates 23, 23 in a cross direction (right and left direction in FIG. 4) is made wider than that of the floating plate 25 and other plates 23 . . . placed over the lower two plates. At a protruding side portion of the lower two plates, the positioning pin 23*b* is formed for positioning the electrical part. Further, a fitting pin 23*c* protruding downward and a bolt 23*d* are formed on the plate 23. The fitting pin 23*c* is fitted into a positioning hole (not shown) of the printed circuit board 13 so that the plate 23 is positioned at a predetermined position of the printed circuit board 13. Then the plate 23 is fixed to the printed circuit board 13 and an insulating plate 33 by screwing up the bolt 23*d* into a nut 32 as shown in FIG. 2.

Figure 6A:
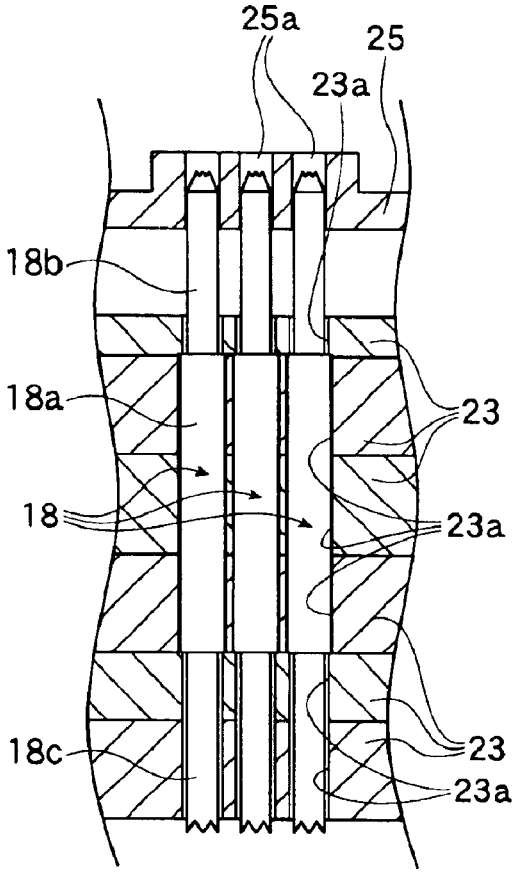
FIGS. 6A and 6B are cross sectional views of the portion where contact pins are disposed in FIG. 1.
Figure 6B:
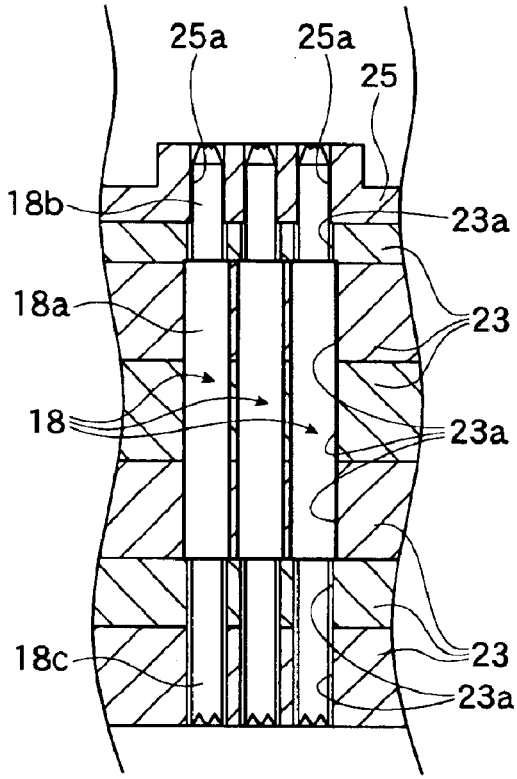

In addition, as shown in FIGS. 6A and 6B, the contact pin 18 is made of a conductive material. Into an upper portion side of a tubular body 18*a*, an upper side contact portion 18*b* is inserted to be vertically moveable. And a lower side contact portion 18*c* is inserted to be vertically moveable into a lower portion side of the tubular body 18*a*. Both upper and lower side contact portions 18*b*, 18*c* are urged in an opposite direction to each other by a spring (not shown) in the tubular body 18*a*.

The tubular body 18*a* of the contact pin 18 is accommodated in the through hole 23*a* of the plates 23 . . . By optionally changing the hole size of the through hole 23*a* of each plate 23 . . . , the tubular body 18*a* can be barred from up and down movement. In other words, the contact pin 18 can be prevented from coming off, being held in the through hole.

Further, the upper side contact portion 18*b* of the contact pin 18 is inserted into a through hole 25*a* of the floating plate 25 and is designed to be contacted with the terminal of the electrical part.

Further, the lower side contact portion 18*c* is inserted into the through hole 23*a* of the lower two plates 23, 23 and is designed to be contacted with an electrode of the printed circuit board 13.

Further, as shown in FIG. 5, the floating plate 25 is disposed to be vertically moveable with respect to the plate 23 through a guide pin 24 and is urged upward by a spring 22. The electrical part is designed to be accommodated on the upper side of the floating plate 25.

Figure 7:
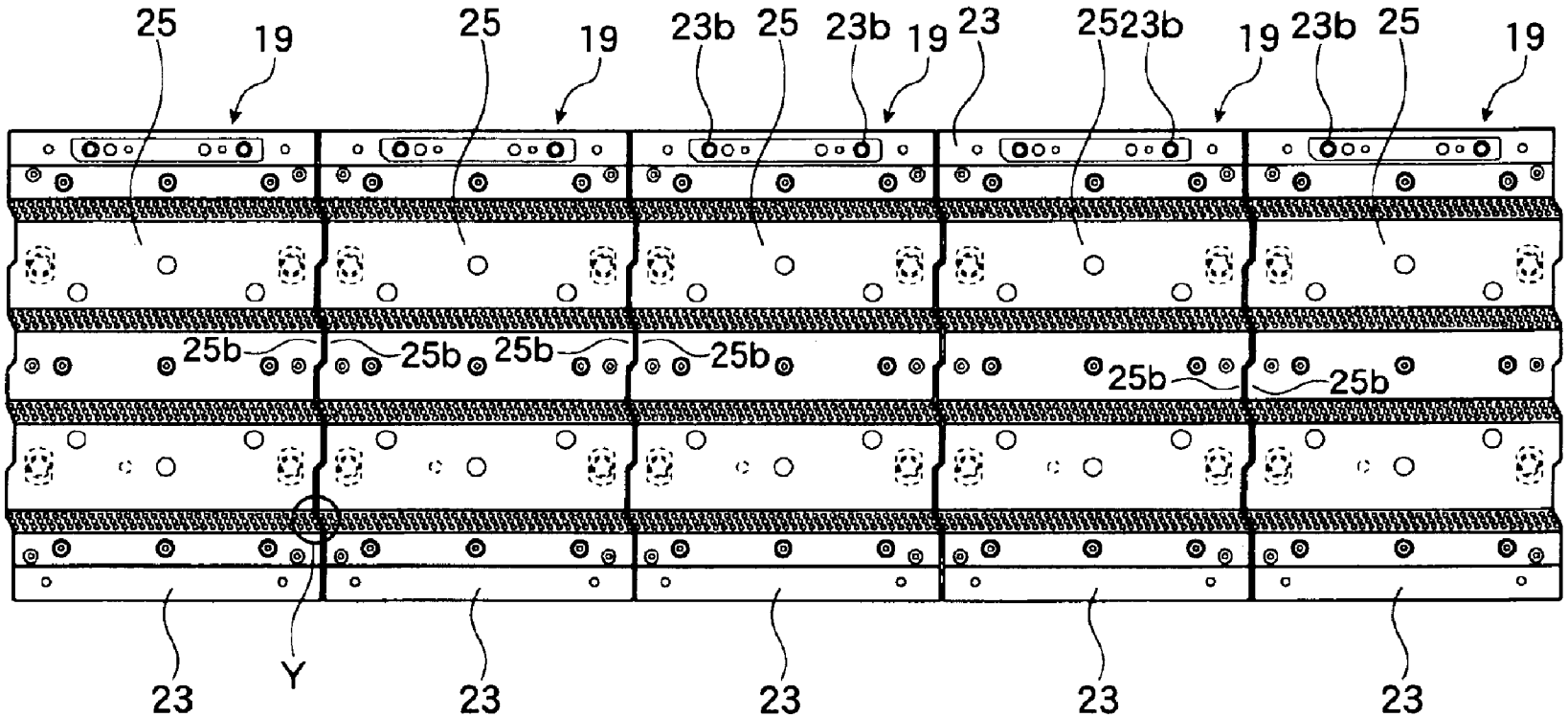
FIG. 7 is a plan view of five contact units of FIG. 1, which are adjacently disposed to each other.

As shown in FIG. 7, a peripheral edge portion 25*b* of the floating plate 25 is formed to be able to be positioned at a place close to other floating plate's peripheral edge portion 25*b* of other IC socket 11 which is disposed next to the socket. And an arrangement of the contact pins 18 is extended up to the peripheral edge portion 25*b*. The contact pins 18 are arranged in four rows along the socket's cross direction (X direction in FIG. 1) so as to be in concert with an arrangement of the terminals of the electrical part. The contact pins 18 in each row are arranged in a zigzag manner and each contact pin 18 is arranged to be contacted with only one terminal.

In a case where the IC socket 11 is adjacently disposed to another socket 11, the floating plates 25 of both IC sockets 11 forms an approximately same continuous plane so that a long electrical part can be mounted on both floating plates 25.

Each of the two peripheral edge portions 25*b* of the floating plate 25 has a convexo-concave portion as shown in FIG. 3. The convexo-concave portion of one peripheral edge portion 25*b* is designed to be fitted to the convexo-concave portion of the peripheral edge portion which is disposed adjacently to the one peripheral edge portion. When a plurality of IC sockets 11 is disposed adjacently, neighboring convexo-concave portions are fitted to each other. But a small clearance c is provided between both floating plates 25 so that each floating plate 25 can be independently moved vertically. (see FIG. 8)

Figure 8:
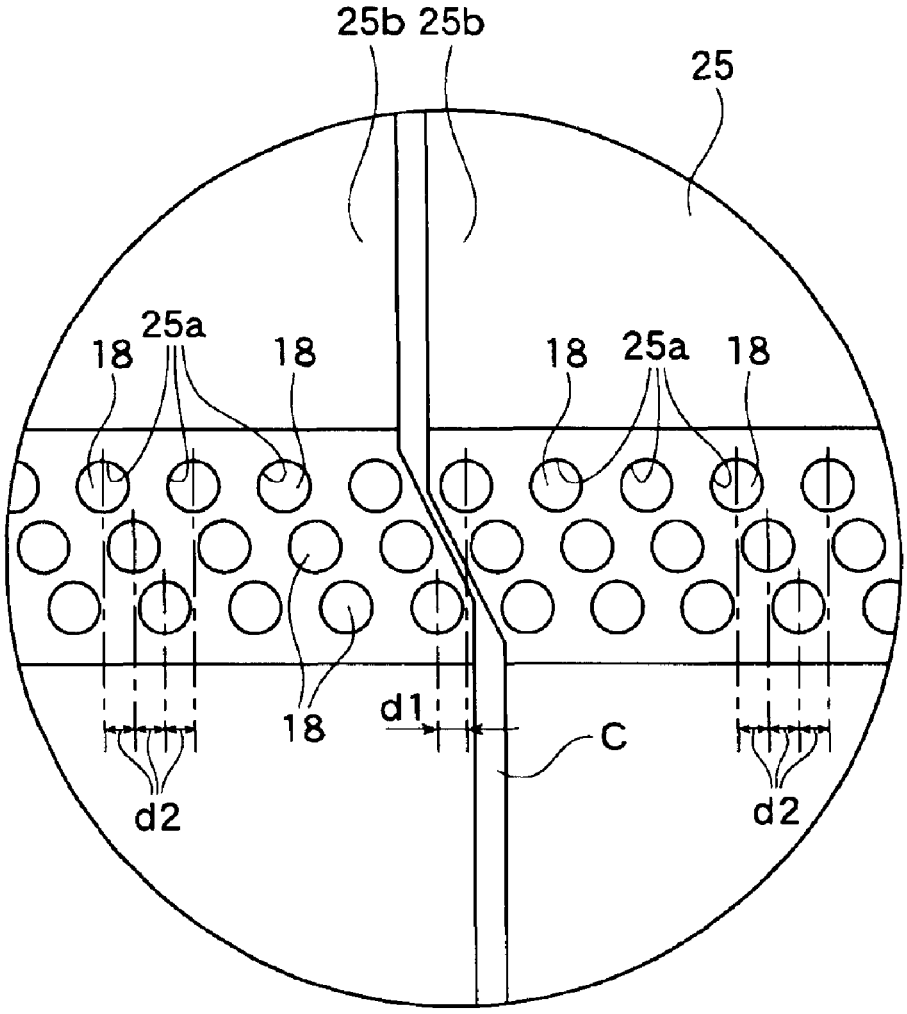
FIG. 8 is an enlarged view of the Y portion of FIG. 7.

As shown in FIG. 3, the arrangement of the contact pins 18 is extended up to the peripheral edge portions 25*b*. Further, as shown in FIGS. 7 and 8, when two sockets are adjacently disposed, a distance d1 (see FIG. 8) between one contact pin 18 disposed to the peripheral edge portion 25*b* of one floating plate 25 and other contact pin 18 disposed to other peripheral edge portion 25*b* of other floating plate 25 which is adjacent to the floating plate 25 is equal to a distance d2 (see FIG. 8) between contact pins 18 adjacently disposed in the one floating plate 25. In other words, d1 is equal to a distance between terminals adjacently disposed on the electrical part.

Further, as shown in FIGS. 1 and 2, the cover supporting member 20 is detachably attached to the plate 23 of the contact unit 19 by the positioning pin 29, and is also attached to the printed circuit board 13 and the insulating plate 33 by a bolt 30 and a nut 31.

As shown in FIGS. 1 and 2, the cover member 16 is rotatably attached to the cover supporting member 20 by a rotating shaft 34 and is urged in an opening direction by a spring 35. A stopper member 36 disposed at a front edge portion of the cover member 16 is designed to be engaged and disengaged with an engaged portion 21*a* formed on an engaging member 21. The stopper member 36 is urged toward an engaging direction (clockwise direction in FIG. 2) by a spring 37.

To the cover member 16, a supporting member 40 is attached to be vertically moveable through a guide pin 39 at the time when the cover member 40 is closed as shown in FIG. 2. In this state, the supporting member 40 is urged downward by a spring 41.

To the supporting member 40, two pressing members 42 are attached swingingly with respect to the supporting member 40 by an axis 43, respectively. The electrical part is pressed by a pressing portion 42*a* formed to the pressing member 42.

Two rows of the pressing portions 42*a* are formed to one pressing member 42 along right and left direction (vertical direction in FIG. 1) in concert with the arrangement of the contact pins 18.

Moreover, as shown in FIG. 2, the engaging member 21, like the cover supporting member 20, is detachably attached to the plate 23 of the contact unit 19 by the positioning pin 29 and is designed to be attached to the printed circuit board 13 and the insulating plate 33 by the bolt 30 and the nut 31.

Next, a method of using the above mentioned IC socket will be explained hereinafter.

First, assembling of the IC socket 11 on the printed circuit board 13 will be explained.

Assembling is started from a stage where the socket body 15 of the IC socket 11 is disassembled into the three parts—the contact unit 19, the cover supporting member 20 and the engaging member 21—.

Figure 9:
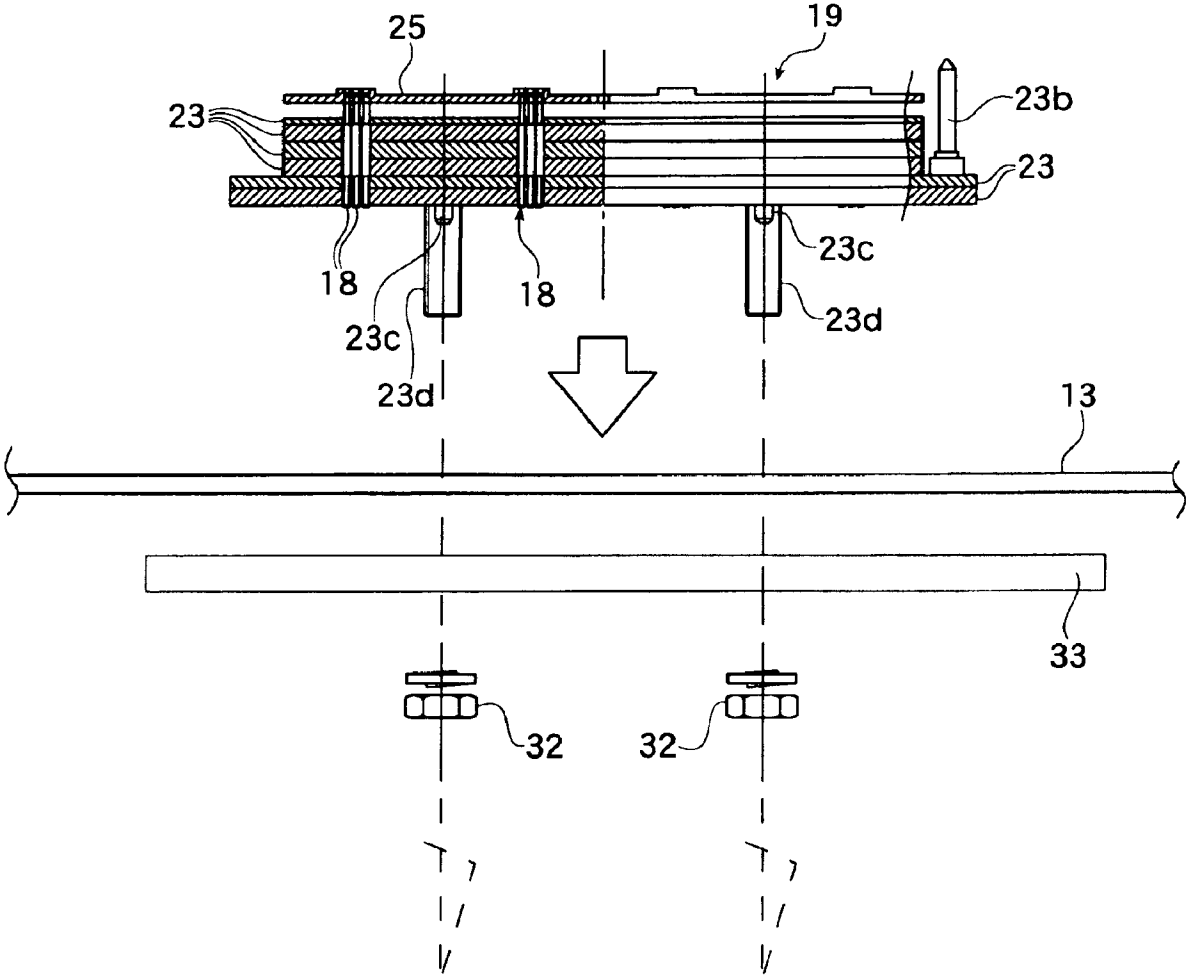
FIG. 9 is a view of a condition of the contact unit of FIG. 1 before the contact unit is mounted on the printed circuit board.

As shown in FIG. 9, the contact unit 19 is at first fixed to the printed circuit board 13. In this embodiment, as shown in FIG. 7, for example, five contact units 19 are adjacently disposed to have a length long enough to accommodate a long electrical part.

Attaching the contact unit 19 to the printed circuit board 13 is carried out as shown in FIG. 9 by disposing the contact unit 19 on a prescribed position of the printed circuit board 13 by fitting the fitting pin 23*c* into a fitting hole (not shown) of the printed circuit board 13. Then the contact unit 19 is fixed to the printed circuit board 13 and the insulating plate 33 by the bolt 23*d* and the nut 32.

In this assembling state, the convexo-concave portion of the peripheral edge portion 25*b* of the floating plate 25 is disposed to be fitted into the convexo-concave portion of other peripheral edge portion 25*b* of an adjacent floating plate 25.

Figure 10:
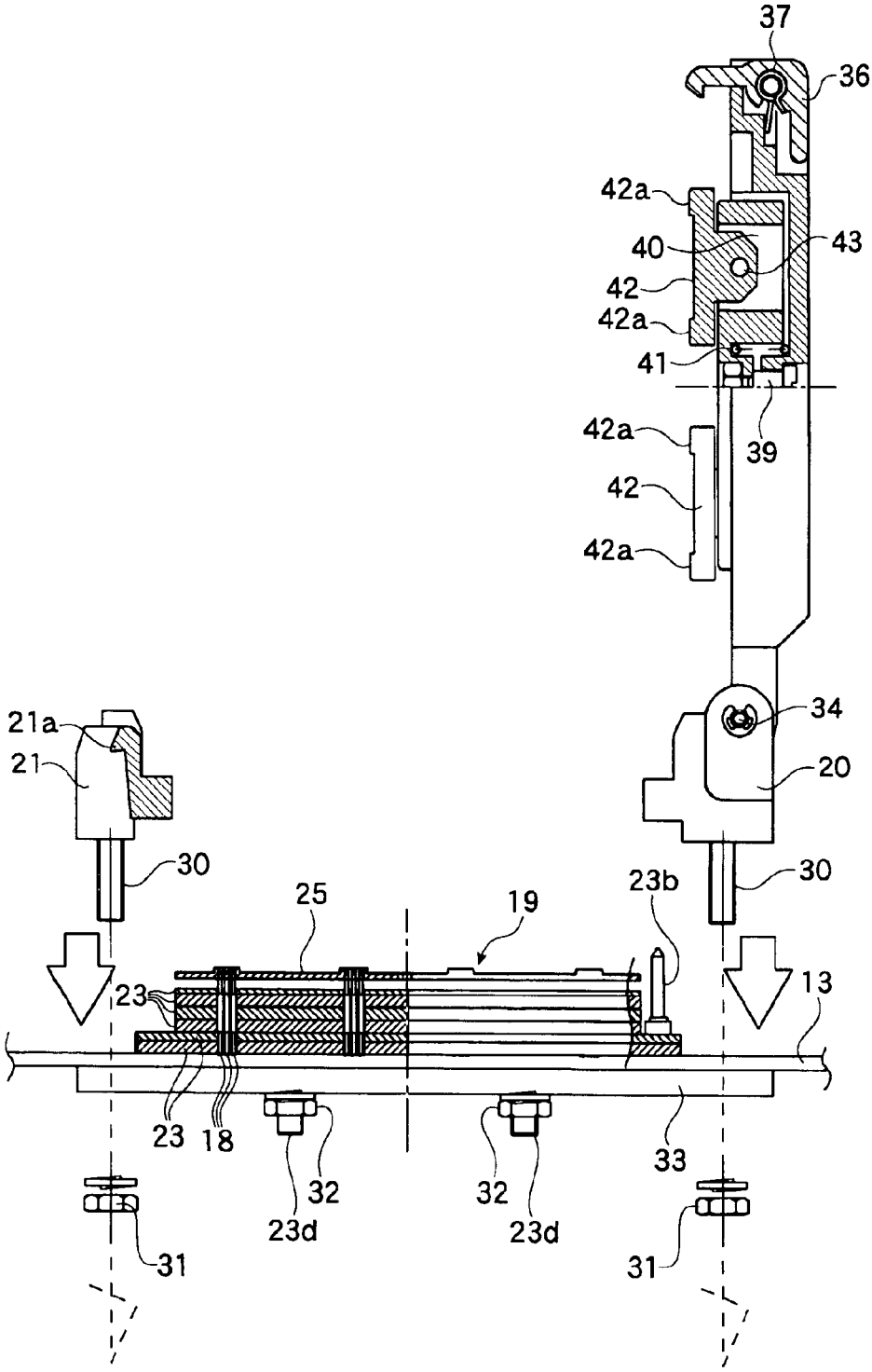
FIG. 10 is a view of the contact unit, a cover supporting member and an engaging member of FIG. 1, the contact unit being mounted on the printed circuit board, but the cover supporting member and the engaging member has not yet been mounted.
Figure 11:
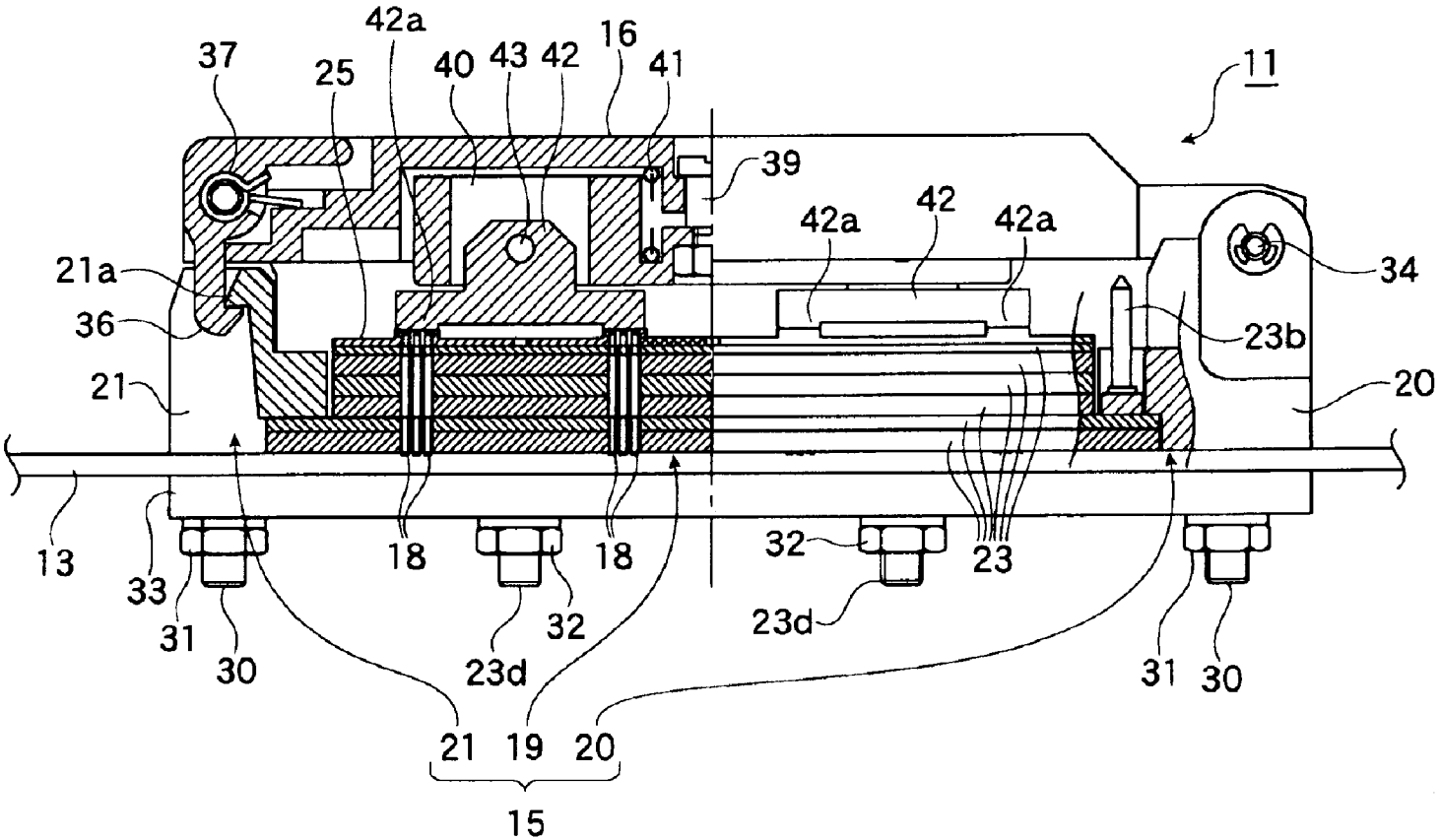
FIG. 11 is a view of the IC socket of FIG. 1 after the IC socket is mounted on the printed circuit board.

Then, the cover supporting member 20 and the engaging member 21 are assembled. As shown in FIG. 10 in which the cover member 16 is already attached to the cover supporting member 20, the cover supporting member 20 is attached to the plate 23 of the contact unit 19 by the positioning pin 29, so that the cover supporting member 20 is positioned with respect to the contact unit 19. Then the cover supporting member 20 is fixed to the printed circuit board 13 and the insulating plate 33 by the bolt 30 and the nut 31.

In the same manner as in the cover supporting member 20, the engaging member 21 is attached to the plate 23 of the contact unit 19 by the positioning pin 29, so that the engaging member 21 is positioned with respect to the contact unit 19. Then the engaging member 21 is fixed to the printed circuit board 13 and the insulating plate 33 by the bolt 30 and the nut 31. (see FIG. 11)

According to the process mentioned above, the contact unit 19 is disposed at a predetermined position of the printed circuit board 13 by using the fitting pin 23*c*. And the cover supporting member 20 and the engaging member 21 are attached to the printed circuit board 13 on the basis of the contact unit 19.

As mentioned above, five IC sockets 11 can be disposed adjacently on the printed circuit board 13. (see FIG. 12)

Next, electrical performance tests procedures will be explained.

Figure 12:
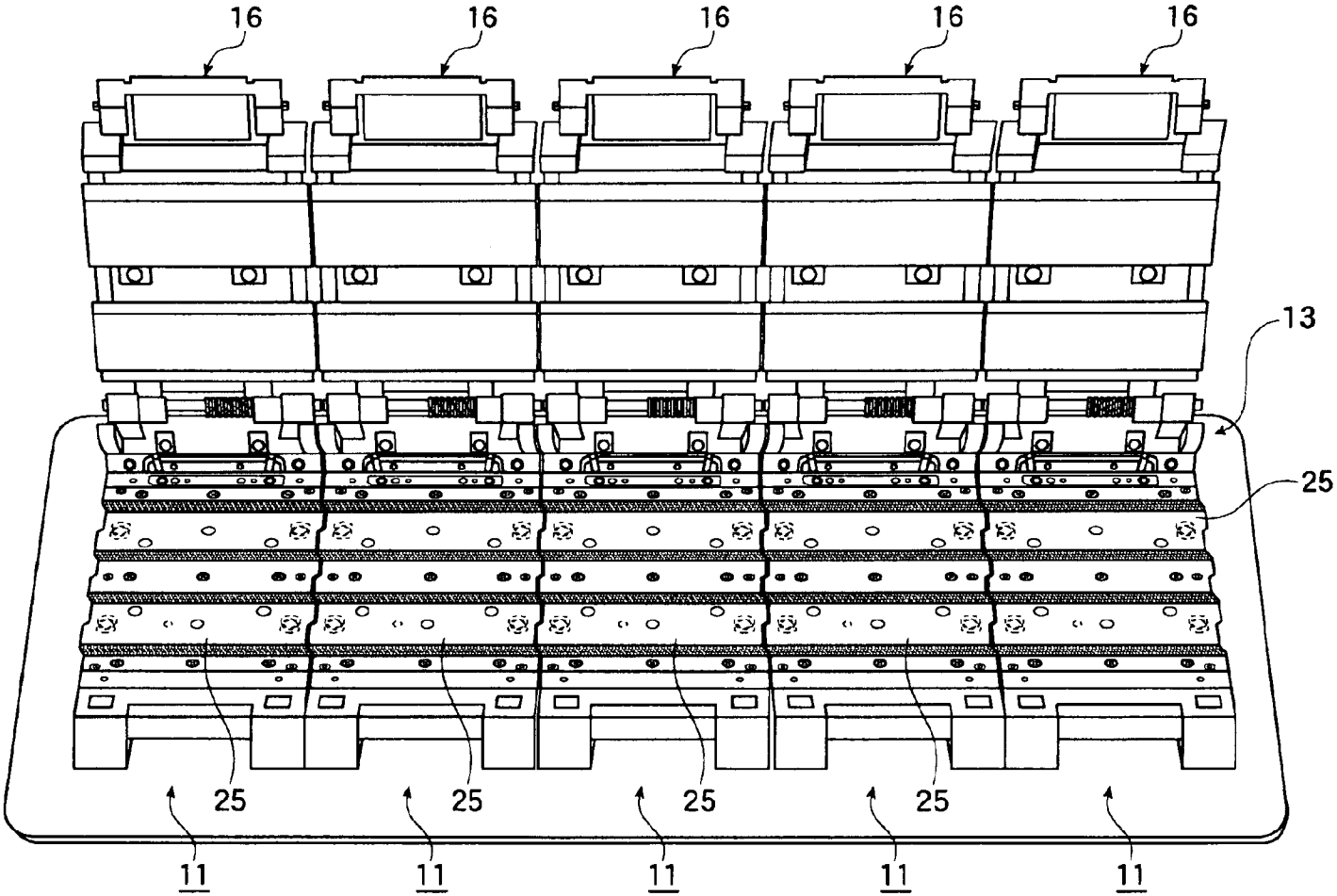
FIG. 12 is a perspective view of five IC socket of FIG. 1, all IC sockets being adjacently disposed and mounted on the printed circuit board with all five cover members opened.

As shown in FIG. 12, the cover members 16 of five IC sockets 11 is at first opened. Then an electrical part having a length 5 times longer than that of the normal electrical part is accommodated on the floating plate 25 after being positioned by the positioning pin 23*b*.

Then the cover member 16 is closed so that the pressing portion 42*a* pushes an upper side of the rows of the terminals of the electrical part. The cover member 16 is completely closed after the stopper member 36 engages with the engaged portion 21*a* of the engaging member 21.

The electrical part is pressed at a prescribed pressure by the supporting member 40 and the spring 41 both disposed in the cover member 16. As the pressing member 42 is swingingly arranged through the axis 43, the four rows of pressing portions 42*a* are effectively abutted against the four rows of the electrical part's terminals, pressing these terminals with even force.

As shown in FIGS. 6A to 6B, the pressing force moves the floating plate 25 downward against the urging force of the spring 22, to establish a contact between the terminals of the electrical part and the upper contact portions 18*b* of the contact pins 18 at a prescribed contacting pressure. Thereby the electrical part and the printed circuit board 13 are electrically connected through the contact pins 18 and then the burn-in test etc. of the electrical part can be carried out.

When the test is finished, the electrical part is taken out from the socket by tracking back the above mentioned process, that is, disengaging the engaging state by rotating the stopper member 36, opening the cover member 16 and then taking out the electrical part.

In the socket of the embodiment mentioned above, each floating plate 25 has an approximately same height so that top surfaces of the two adjacently disposed floating plates 25 are structured to be in an approximately one flat plane. That is, there is no obstacle between the adjacent floating plates 25 so that a long plate-like electrical part can be accommodated on the floating plates 25 in such a manner as bridging the IC sockets. In the conventional IC sockets, each independent IC package is accommodated and tested on the IC socket one by one, but in the present invention, even a long plate-like electrical part which has a length longer than the IC socket 11 can be suitably tested.

In addition, by changing the number of IC socket 11, electrical parts having various length can be successfully accommodated and tested.

Further, the peripheral edge portion 25*b* of the floating plate 25 is designed to be disposed close to other peripheral edge portion 25*b* of other floating plate 25 of the adjacent IC socket 11 so that no wide clearance exists between both floating plates 25. Therefore, accommodation of an electrical part can be conveniently carried out when the electrical part is accommodated on the sockets in the bridging manner.

Further, the contact pins 18 are arranged up to the peripheral edge portion 25*b* of the floating plate 25. And moreover, the distance between the adjacent contact pins 18 each of which is disposed to each peripheral edge portion 25*b* of the adjacent floating plates 25 respectively is made equal to the distance between the adjacent terminals of the electrical part so that the contact pins 18 can be surely contacted with the terminals of the electrical part respectively even at the boundary portions of the adjacent floating plates 25. Therefore, the performance test of the electrical part can be surely carried out.

Further, a plurality of rows of the pressing portions 42*a* of the pressing member 42 are formed along the right and left direction so that the rows of the terminals of the electrical part can be effectively pressed on the contact pins 18.

Furthermore, the socket body 15 is divided into three parts—the contact unit 19, the cover supporting member 20 and the engaging member 21—, and the cover supporting member 20 and the engaging member 21 are each positioned at each side of the contact unit 19, respectively. Therefore there is no frame-like portion on the sides of the contact unit 19 (on the sides of the peripheral edge portions 25*b* of the floating plate 25) so that the adjacent two floating plates 25 can be closely disposed to each other, being able to accommodate the long electrical part over the adjacent two floating plates in such a manner as bridging the floating plates. Electrical performance test etc. of the long electrical part can be effectively carried out. Further, in a case where a portion of one of the three divided parts deteriorates, maintenance of the IC socket can be carried out only by replacing the deteriorated portion, being easy to repair and economical.

In addition, with respect to one electrical part which is accommodated on the socket, the socket of the present invention is comprised of a plurality of IC sockets 11 (contact unit 19 which accommodates a plurality of contact pins 18) which are adjacently disposed. Therefore, when replacement of the contact pin 18 is needed, disassembling of the contact unit 19 and replacement of the contact pin 18 can be easily conducted, because in the present invention, the number of contact pins 18 in one unit of IC socket is smaller when compared with a conventional IC socket which is structured in one body. Further, in a case where the IC socket 11 (contact unit 19) is molded by using mold dies articles, the mold dies for producing the IC sockets can be downsized so that the production cost of the mold dies can be lowered.

SECOND EMBODIMENT

Figure 13:
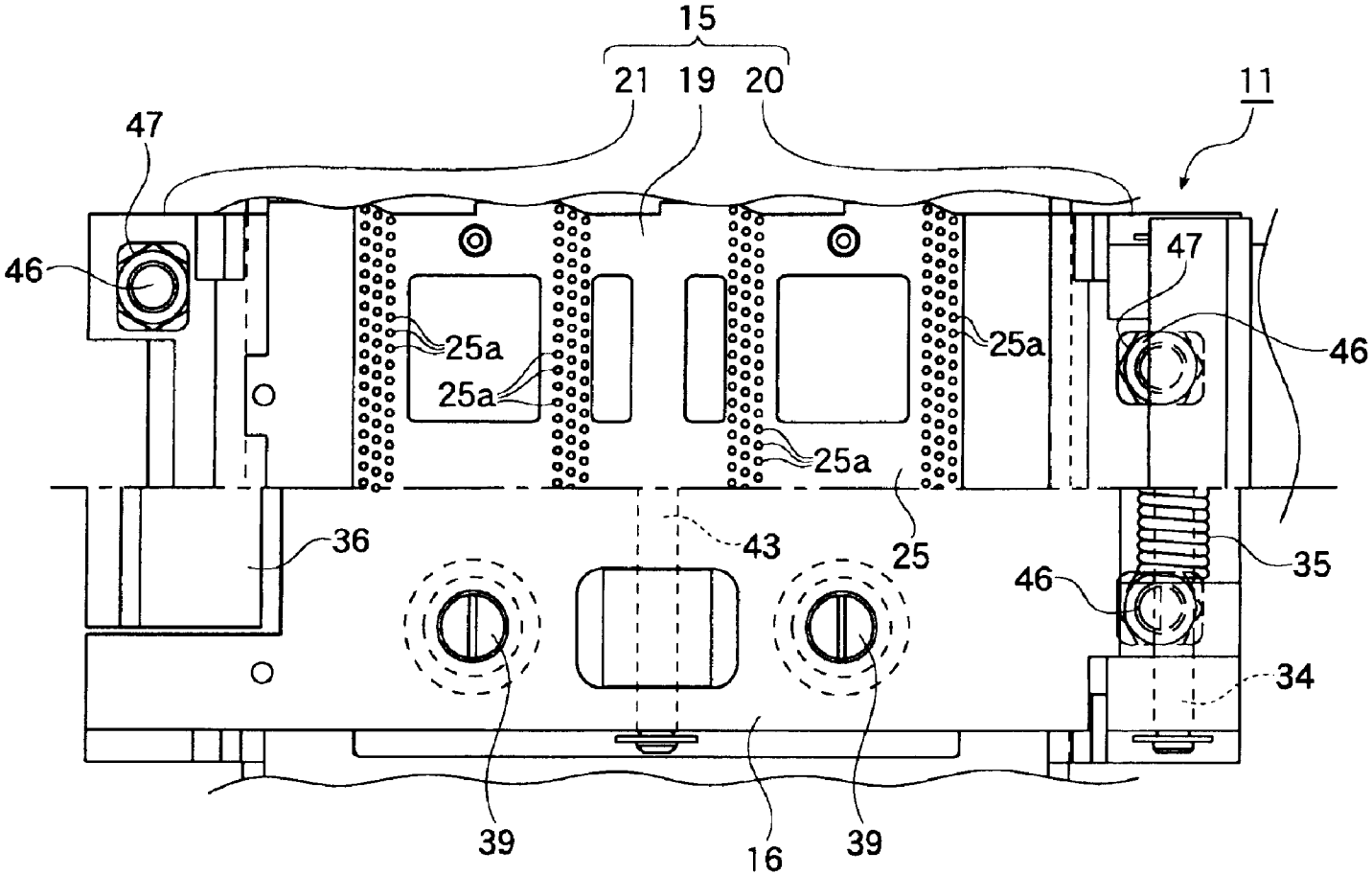
FIG. 13 is a plan view of an IC socket of a second embodiment, an upper half of a cover member being opened.
Figure 14:
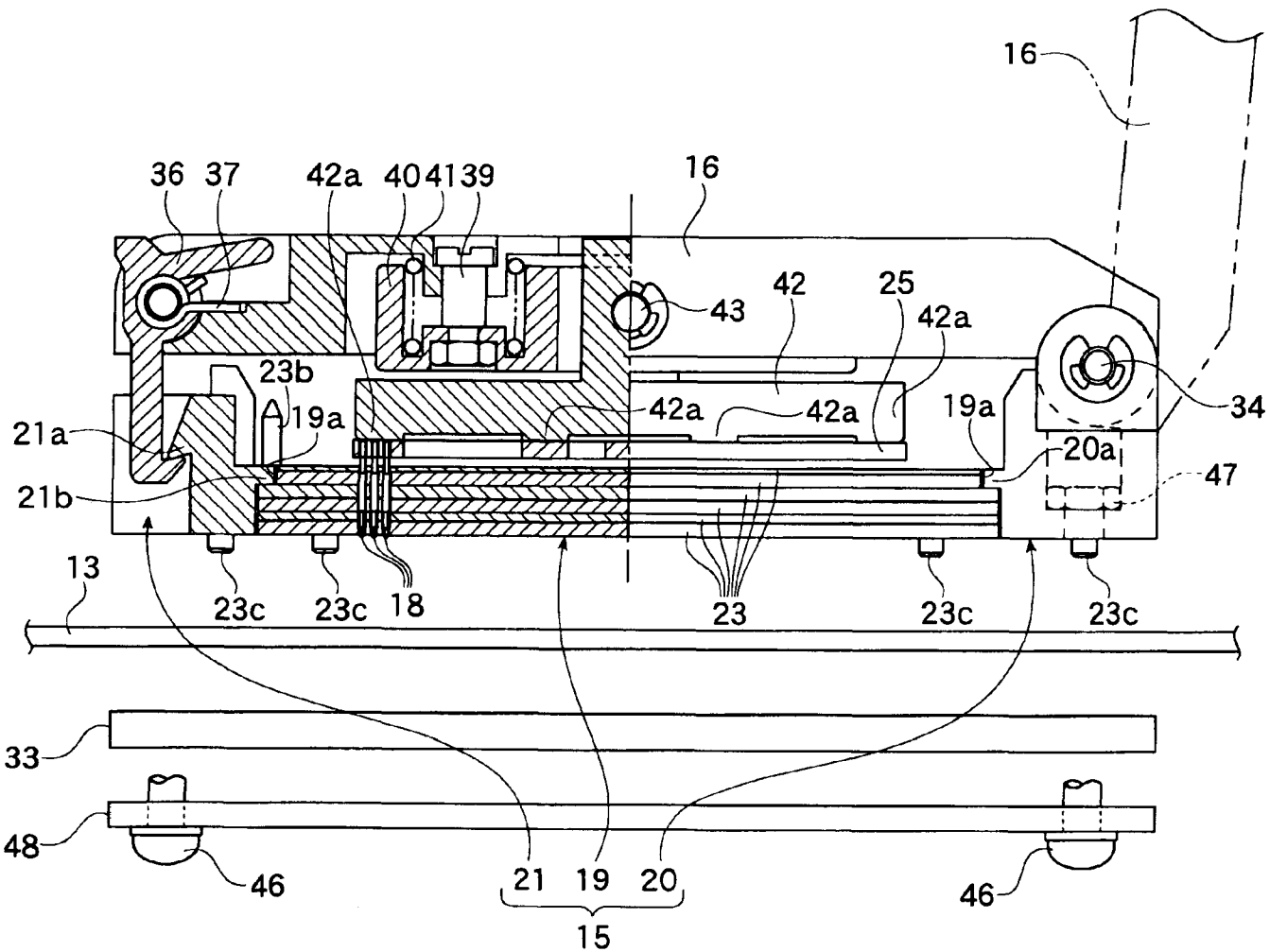
FIG. 14 is a front view of the IC socket of FIG. 13, a left portion showing a half cross sectional view.
Figure 15:
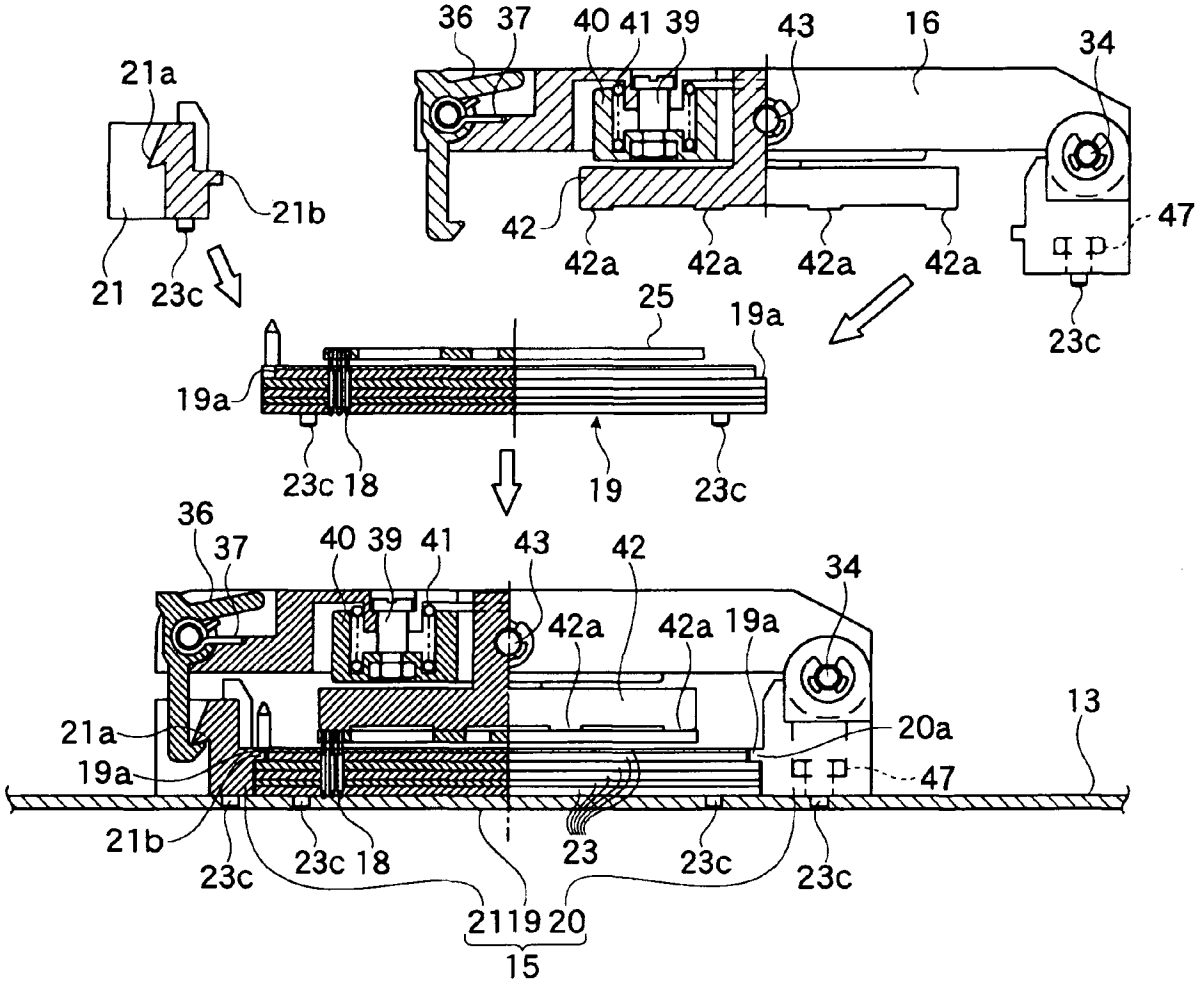
FIG. 15 is a view of a mounted state of the IC socket of FIG. 13 mounted on the printed circuit board, upper three views showing three decomposed parts of the IC socket.

FIGS. 13 to 15 show the second embodiment of the present invention.

The second embodiment is different from the first embodiment in structures of both the cover supporting member 20 and the engaging member 21 with respect to the contact unit 19, and in a structure etc. of the pressing member 42 attached to the cover member 16.

That is, on the cover supporting member 20 and the engaging member 21, engaging projections 20*a*, 21*b* which are engaged with engaging recess portions 19*a* of the contact unit 19 and the fitting pin 23*c* fitted into the printed circuit board 13 are formed.

Further, these cover supporting member 20 and the engaging member 21 are designed to be attached, by a bolt 46 and a nut 47, to the printed circuit board 13, the insulating plate 33 and a reinforcing plate 48 which is used for preventing the printed circuit board 13 from warping.

Attaching the contact unit 19 to the printed circuit board 13 can be carried out as follows, that is, at first positioning the contact unit 19 on the printed circuit board 13 by the fitting pin 23*c*; then attaching both cover supporting member 20 and the engaging member 21 to the printed circuit board 13 etc. by using the bolt 46 and the nut 47, and at the same time making the engaging projections 20*a*, 21*b* of the cover supporting member 20 and the engaging member 21 engage from above with the engaging recess portions 19*a* of the contact unit 19. According to the above-mentioned process, attaching the contact unit 19 to the printed circuit board 13 is completed.

Accordingly, attaching and detaching work of the contact unit 19 can be carried out easily because the contact unit 19 is not attached to the printed circuit board 13 by a screw.

In the first embodiment, two pressing members 42 are formed on one cover member 16. But in the second embodiment, one pressing member is formed on one cover member. And four rows of the pressing portions 42*a* are formed on one pressing member 42.

Explanations of other structures and operations are omitted as other structures and operations are similar to the socket of the first embodiment.

In addition, in the above-mentioned embodiments, the present invention is applied to the IC socket 11 as a "socket for electrical parts". But it is noted that the present invention is not limited to the described embodiments, but can be of course applied to other devices. Moreover, the IC socket 11 is not limited to the above mentioned embodiments, but can be applied to IC sockets which can accommodate other type of electrical parts (IC packages) such as BGA (Ball Grid Array), LGA (Land Grid Array) etc.

Further, in the embodiment described above, the present invention is applied to the electrical part, in which a plurality of IC packages are combined together to be one long combined electrical part. But the present invention is not limited to the embodiments and can be suitably used for conducting performance testing of one (single) electrical part.

What is claimed is:

1. A plurality of sockets disposed adjacently to each other on a circuit board, each socket comprising:

a contact pin;

a socket body comprising an accommodating surface portion having a same height as the accommodating surface portion of each of the other of the plurality of sockets so that an electrical part is mounted over the accommodating surface portions of the plurality of sockets, respectively, so as to bridge the plurality of accommodating surface portions; and a cover member rotatably attached to the socket body and having an opened and closed position so that the cover member is rotated from the opened position to the closed position to thereby press the electrical part which thereby causes the electrical part to be electrically connected with the circuit board via the contact pin.

2. A plurality of sockets disposed adjacently to each other on a circuit board, each socket comprising:

a contact pin;

a socket body comprising an accommodating surface portion having a same height as the accommodating surface portion of each of the other of the plurality of sockets so that an electrical part is mounted over the accommodating surface portions of the plurality of sockets, respectively, so as to bridge the plurality of accommodating surface portions;

a cover member rotatably attached to the socket body and having an opened and closed position; and means, when the cover member is rotated from the opened position to the closed position, for pressing the electrical part to thereby cause the electrical part to be electrically connected with the circuit board via the contact pin.

3. A plurality of sockets for an electrical part, each socket comprising:

a socket body to be mounted on a circuit board and to accommodate the electrical part; and a plurality of contact pins disposed in the socket body, through which the circuit board and the electrical part are electrically connected, wherein the socket body comprises a contact unit in which the contact pins are disposed, the contact unit having first and second end portion sides, a cover supporting member attached to the first end portion side of the contact unit, the cover supporting member having a cover member rotatably attached to the cover supporting member, and an engaging member for engaging a front edge portion side of the cover member, the engaging member being provided at the second end portion side of the contact unit, and the contact unit includes an accommodating surface portion to accommodate the electrical part, a height of the accommodating surface portion having an approximately same height as that of an adjacent socket so that a plurality of the sockets are disposed adjacently to each other, and the electrical part is mounted over a plurality of accommodating surface portions of the plurality of sockets, respectively, so as to bridge the plurality of accommodating surface portions.

4. A plurality of sockets for an electrical part, the plurality of sockets being disposed adjacently to each other, an each socket comprising:

a socket body which is mounted on a circuit board and accommodates the electrical part; and a contact pin disposed in the socket body, through which the circuit board and the electrical part are electrically connected, the socket body comprising an accommodating surface portion to accommodate the electrical part and having first and second end portion sides, a cover supporting member attached to the first end portion side of the accommodating surface, a cover member having first end second end portion sides, the cover member rotatably attached to the cover supporting member at the first end portion side of the cover member, and an engaging member attached to the second end portion side of the accommodating surface portion, to engage the second end portion side of the cover member, wherein the socket has first and second opposite sides, a height of the accommodating surface portion is approximately a same height as that of any socket disposed adjacently to the first opposite side or the second opposite side, and the electrical part is mounted over a plurality of accommodating surface portions of the plurality of sockets, respectively, in such a manner as to bridge the plurality of accommodating surface portions.

5. The plurality of sockets for an electrical part according to claim 4, wherein, for each socket, the accommodating surface portion is a floating plate made to be vertically moveable and urged upward, the floating plate having a through hole through which the contact pin is inserted.

6. The plurality of sockets for an electrical part according to claim 4, wherein, for each socket, a peripheral edge portion of the accommodating surface portion is formed to be positioned at a place close to a peripheral edge portion of the accommodating surface portion of another socket disposed adjacent to the socket.

7. The plurality of sockets for an electrical part according to claim 6, wherein, for each socket, the contact pins are disposed up to the peripheral edge portion of the accommodating surface portion.

8. The plurality of sockets for an electrical part according to claim 4, each socket further comprising:

a pressing member for pressing the electrical part, the pressing member being attached to the cover member and including pressing portions lined up in a plurality of rows.

* * * * *

UNITED STATES PATENT AND TRADEMARK OFFICE

CERTIFICATE OF CORRECTION

PATENT NO. : 6,929,486 B2
DATED : August 16, 2005
INVENTOR(S) : Hideo Shimada

It is certified that error appears in the above-identified patent and that said Letters Patent is hereby corrected as shown below:

Column 12,
Line 21, after "first" delete "end" and insert -- and --.

Signed and Sealed this

Twenty-eighth Day of March, 2006

JON W. DUDAS
*Director of the United States Patent and Trademark Office*